US006854700B2

(12) United States Patent
Schmitz

(10) Patent No.: US 6,854,700 B2
(45) Date of Patent: Feb. 15, 2005

(54) FOOT SUPPORT FOR ESSENTIALLY CYLINDRICAL ELEMENTS

(76) Inventor: Hans-Jörg Schmitz, Schulstr. 4, 42579, Heiligenhaus (DE)

( * ) Notice: Subject to any disclaimer, the term of this patent is extended or adjusted under 35 U.S.C. 154(b) by 0 days.

(21) Appl. No.: 10/468,466

(22) PCT Filed: Jan. 31, 2002

(86) PCT No.: PCT/DE02/00347

§ 371 (c)(1),
(2), (4) Date: Feb. 2, 2004

(87) PCT Pub. No.: WO02/065882

PCT Pub. Date: Aug. 29, 2002

(65) Prior Publication Data

US 2004/0129854 A1 Jul. 8, 2004

(30) Foreign Application Priority Data

Feb. 23, 2001 (DE) ..... 101 08 999

(51) Int. Cl.[7] ..... F16M 13/00
(52) U.S. Cl. ..... 248/523; 248/511; 248/525
(58) Field of Search ..... 248/511, 523, 248/539, 188.2, 519, 525; 47/40.5, 44.11

(56) References Cited

U.S. PATENT DOCUMENTS 2,896,293 A * 7/1959 Love ..... 248/523
3,801,053 A * 4/1974 Laute ..... 47/40.5
5,114,113 A * 5/1992 Krinner ..... 248/525
5,507,117 A * 4/1996 Kalman et al. ..... 47/40.5
5,707,037 A * 1/1998 Pastrick ..... 248/516
6,019,341 A * 2/2000 Brown et al. ..... 248/516
6,283,436 B1 * 9/2001 Schulz et al. ..... 248/523
2004/0026594 A1 * 2/2004 Lee ..... 248/523
2004/0099782 A1 * 5/2004 Schulz ..... 248/346.06

* cited by examiner

*Primary Examiner*—Anita King
*Assistant Examiner*—Amy J. Sterling
(74) *Attorney, Agent, or Firm*—Gudrun E. Huckett

(57) ABSTRACT

A foot support for profiled sections has a base member; a receptacle for the profiled section arranged in the base member; and several tensioning levers having a horizontal pivot axis and arranged about an axis of symmetry. The tensioning levers are pivotable between a rest position and a clamping position about the horizontal pivot axis. The tensioning levers have a lower lever arm positioned below the horizontal axis and an upper lever arm positioned above the horizontal pivot axis. A foot-actuated actuating element that acts on a force-transmitting element, acting on the tensioning levers for moving them into the clamping position, is provided. The force-transmitting element is a vertically adjustable ring that, when carrying out a downward movement, contacts the lower lever arms of the tensioning levers such that the lower lever arms are pivoted outwardly and the upper lever arms are pivoted inwardly into the clamping position.

12 Claims, 2 Drawing Sheets

FOOT SUPPORT FOR ESSENTIALLY CYLINDRICAL ELEMENTS

BACKGROUND OF THE INVENTION

The invention relates to a foot support for substantially cylindrical profiled sections comprising a base member, a receptacle for the profiled section arranged in the base member, several holding elements, arranged about an axis of symmetry, in the form of twin-arm tensioning levers which are pivotable between a rest position and a clamping position about horizontal pivot axes in vertical planes which substantially intercept one another in an axis of symmetry, and a foot-actuated actuating element engaging by means of a force transmitting element all tensioning levers for moving them into the clamping position.

Such a foot support which, according to DE 39 32 473 C2, serves as a Christmas tree stand, can also be used for other purposes, for example, for posts and supports of any kind, for example, table legs, flagpoles and the like.

In the known Christmas tree stand according to DE 39 32 473 C2, the force transmitting element is a flexible connecting part, in particular, a steel cable, which is loadable by tension forces. This steel cable engages the lever arms positioned above the pivot axis of the tensioning levers, i.e., in an area through which the trunk of the Christmas tree must be inserted into the container of the Christmas tree stand. Aside from the fact that such a steel cable can catch on other components of the Christmas tree stand, such an arrangement of the steel cable also makes the insertion of the trunk into the Christmas tree stand more difficult.

The Christmas tree stand according to AT 403 542 B has a base on which two-arm tensioning levers are pivotably supported. The free ends of the tensioning levers facing away from the base are loaded by the force of springs into a clamping position in which the tree is secured while the tensioning levers, on the other hand, are moved by means of a foot pedal against the force of these springs into the open position.

SUMMARY OF THE INVENTION

It is an object of the invention to provide a foot support that, in comparison to the Christmas tree stand according to DE 39 32 473 C2, is simplified with regard to its construction as well as its handling.

The solution to this object is characterized in that the force transmitting element is configured as a ring adjustable in the vertical direction which, by carrying out a downwardly oriented movement, can be brought into contact against the lever arms positioned underneath the pivot axes of the tensioning levers such that these lower lever arms are pivoted outwardly and, in this way, the upper lever arms of the tensioning levers are pivoted inwardly into the clamping position. In that, according to the invention, the force transmitting element engages the lever arms of the tensioning levers positioned underneath the pivot axes, the access to the container receiving the post, for example, a tree trunk, remains free and open so that the insertion of the post into the container is simplified.

Additional features of the invention and the advantages derived therefrom result from the dependent claims.

BRIEF DESCRIPTION OF THE DRAWINGS

The invention will be explained in more detail in the following with the aid of the drawing.

DESCRIPTION OF PREFERRED EMBODIMENTS

The support leg according to the invention serves for securing and fixation of particularly cylindrical posts, wherein the term post includes tree trunks, in particular, Christmas tree trunks, as well as posts in general.

Figure 1:
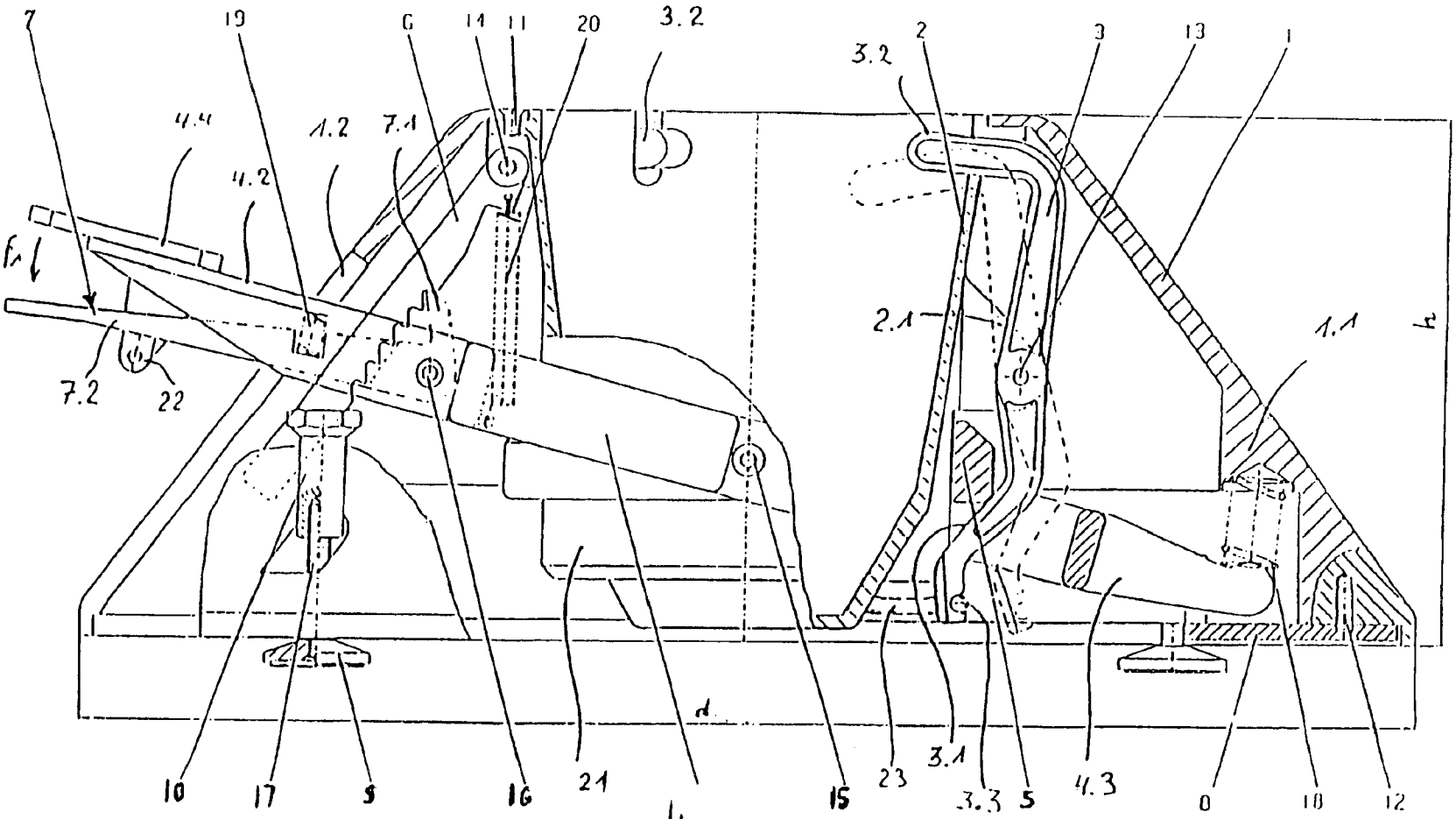
FIG. 1 shows partially in section a view of the foot support according to the invention.

The foot support is comprised of a base member 1, particularly a rotationally symmetrical one, in which a container 2 is fastened, for example, by means of screws 11, which, as illustrated, preferably tapers conically in two steps in a downward direction. On the outer wall of this container 2, which forms a receptacle for the lower end of the tree trunk or the post, holding elements in the form of twin-arm tensioning levers 3 are supported, for example, by means of support lugs 2.1, wherein the tensioning levers are pivotable about horizontal axes 13. Preferably three twin-arm levers 3 are provided which are distributed at a uniform angular spacing relative to one another. Each lever 3 has at its lower lever arm 3.1 positioned underneath the pivot axes 13 a guide section 3.1 extending slantedly downwardly from the top toward the axis of rotation of the base member 1. The lever arm of each lever 3 positioned above the pivot axes 13 has an inwardly oriented clamping or tensioning element 3.2 which projects through an opening provided in the container 2 into the interior of the container 2. In FIG. 1, the lever 3 is illustrated in solid lines in its rest position or initial position in which the upper lever arm has been pivoted back to the rear.

Figure 2:
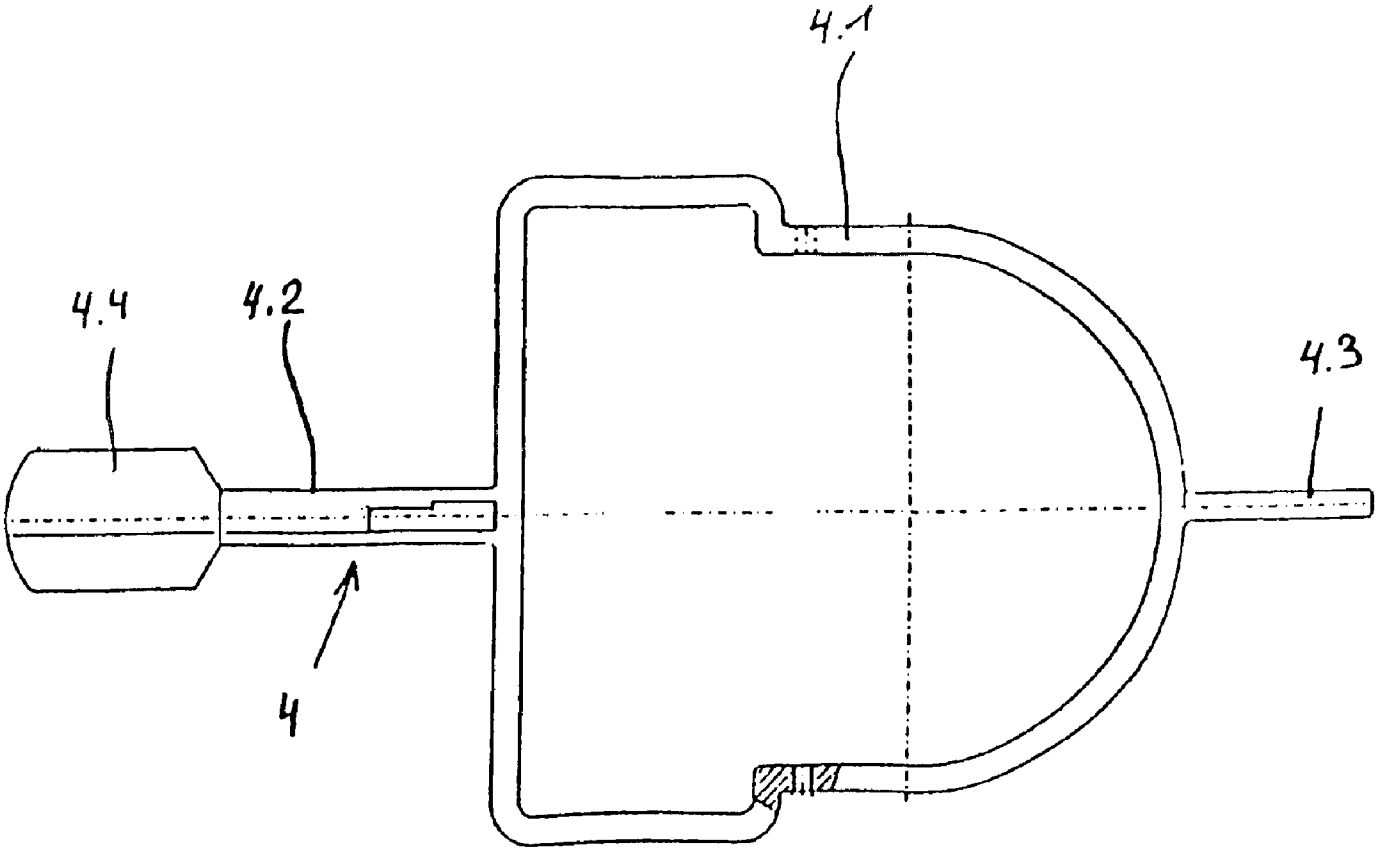
FIG. 2 shows a plan view onto the force transmitting element.

The lower end of the container 2 is surrounded by a stationary cylinder body 21 along whose outer wall a force transmitting element in the form of a ring 5 is slidably guided. An actuating element 4 is connected to this ring 5 by means of bearing pins 15; the actuating element is illustrated in FIG. 2 in a plan view and surrounds the ring 5. This element 4 is comprised preferably of a bracket closed on all sides and having dimensions matched substantially to the outer circumference of the ring 5 such that the actuating element 4 can be pivoted relative to the ring 5. The actuating element 4, which accordingly is configured as a pivot lever, is provided at its first end with a foot lever 4.2 having a foot pedal 4.4 and on its second end with a support lever 4.3 that has on its upper side a pressure spring 18 having a high spring stiffness and being supported with its lower end on the upper side. The upper abutment for the pressure spring 18 is formed by an inwardly oriented projection 1.1 of the base member 1. The pressure spring 18 that loads the support lever 4.3 with a downwardly oriented force and the support lever 4.3 are matched to one another with regard to their size such that the support lever 4.3 and the pressure spring 18 form a support location for the pivot lever 4 which, upon pivoting of the pivot lever 4, is moved inwardly or outwardly in the area of the support lever 4.3.

In the upper area of the container 2, optionally also in the upper area of the base member 1, a toothed rack 6 is attached by means of a bearing pin 14 which at its underside is provided with downwardly oriented ratchet-like teeth.

Between the pivot lever 4 and the toothed rack 6 a tension spring 20 is suspended such that, on the one hand, the toothed rack 6 is pulled inwardly with its teeth, i.e., in the direction of a ratchet pawl 7.1 to be described in the following, while, on the other hand, the pivot lever 4 is loaded with an upwardly oriented force.

On the foot lever 4.2 of the pivot lever 4 extending outwardly through an opening 1.2 of the base member 1, a substantially L-shaped ratchet lever 7 is attached by means of a bearing pin 16; the ratchet lever comprises a ratchet pawl 7.1 engaging the tooth gaps of the toothed rack 6 and comprises a release lever 7.2. Between the foot lever 4.2 and the release lever 7.2 of the ratchet lever 7 a pressure spring 19 is arranged such that the ratchet pawl 7.1 is loaded in the direction of the toothed rack 6. A support element 22 is arranged on the foot lever 4.2 which serves for limiting the pivot movement of the release lever 7.2, initiated by the pressure spring 19, in the downward direction.

On the underside of the base member 1 a preferably annular bottom 8 is fastened by means of screws 12. For leveling the foot support, the bottom area is provided with adjusting screws 9, 17, which cooperate with threaded nuts 10.

Each tensioning lever 3 is provided at the outer side of its lower lever arm with a notch 3.3. A schematically indicated annular spring 23 is inserted into each of the notches 3.3 of all tensioning levers 3; the annular springs maintain the tensioning levers 3 in the rest position or pull them back into the rest position. In this rest or initial position illustrated in FIG. 1, the pivot lever 4 is loaded, on the one hand, by the pressure spring 18 and, on the other hand, by the tension spring 20 such that it is pivoted upwardly, together with the foot lever 4.2 positioned outside of the base member 1; in this way, the ring 5 reaches its upper position. The tensioning levers 3 are in the position illustrated in solid lines so that, for example, the lower end of a tree trunk can be inserted into the container 2 so that the lower trunk end will be centered in the conical part of the container. Subsequently, the pivot lever 4 is pushed downwardly in the direction of arrow f1 by stepping on the foot pedal 4.4 so that the pivot lever, supported by means of the pressure spring 18, is pivoted substantially about the support location between the spring 18 and the lever end about the bearing pins 15 mounted on the ring 5 and, in this way, pushes the ring 5 downwardly so that it glides along the slantedly extending guide surfaces 3.1 of the tensioning lever 3. In this way, the tensioning levers 3 with their tensioning elements 3.2 are pivoted inwardly against the trunk end inserted into the container 2 into the contact position indicated in dashed lines. The ratchet lever 7 follows the pivot movement in the downward direction indicated by the arrow f1 wherein the ratchet pawl 7.1 glides downwardly along the teeth of the toothed rack 7 until this ratchet pawl 7.1, as a function of the thickness of the trunk or post, locks relative to one of the teeth of the toothed rack 6. It is understood that the teeth are designed such that the ratchet lever 7.1 can glide downwardly along the correspondingly designed toothed flanks during the downwardly oriented movement with simultaneous minimal lifting of the toothed rack 6.

For releasing the system for removing the tree trunk or the like, the lever arm 7.2 of the ratchet lever 7 is moved upwardly, for example, by foot actuation, against the force of the pressure spring 19 so that the ratchet pawl 7.1 is released from the toothed rack 6 such that the pivot lever 4 is pivoted upwardly by the tension spring 20, assisted by the pressure spring 18, against the direction of the arrow f1 with simultaneous entrainment of the ring 5 in the upward direction. The annual spring 23 which engages the lower ends of the tensioning lever 3 can then pivot back the tensioning levers from the tensioning position illustrated in dashed lines into the initial position illustrated in solid lines.

The clamping noses 3.2 can have, for example, the shape of clamping jaws or the like.

Of course, the foot support according to the invention, when provided with a corresponding arrangement of the tensioning levers 3, can be used for positioning upright profiled sections having a cross-section that is not round.

What is claimed is:

1. A foot support for a substantially cylindrical profiled section, the foot support comprising:

a base member;

a receptacle arranged in the base member for receiving the profiled section;

several holding elements, arranged about an axis of symmetry, in the form of twin-arm tensioning levers each having a horizontal pivot axis, wherein the tensioning levers are pivotable between a rest position and a clamping position about the horizontal pivot axis in vertical planes, wherein the vertical planes substantially intercept one another at the axis of symmetry;

wherein the tensioning levers each have a lower lever arm positioned below the horizontal axis and an upper lever arm positioned above the horizontal pivot axis, respectively;

a foot-actuated actuating element;

a force-transmitting element acted on by the actuating element and acting on the tensioning levers for moving the tensioning levers into the clamping position;

wherein the force-transmitting element is a ring that is vertically adjustable and, when carrying out a downwardly oriented movement, contacts the lower lever arms of the tensioning levers such that the lower lever arms are pivoted outwardly and the upper lever arms are pivoted inwardly into the clamping position.

2. The foot support according to claim 1, wherein the lower lever arms have guide sections extending from above at a slant downwardly toward the axis of symmetry.

3. The foot support according to claim 1, wherein the actuating element is a twin-arm pivot lever having a central area connected to the ring and being comprised of a foot lever extending outwardly from the base member and a support lever supported inside the base member against a spring force of a pressure spring.

4. The foot support according to claim 3, wherein the support lever has a first lever end having an upper side resting against an underside of the pressure spring, wherein the pressure spring has an upper end supported on the base member.

5. The foot support according to claim 1, wherein tensioning levers each have on the upper lever arm an inwardly oriented clamping element movable into the receptacle through an opening provided in the receptacle.

6. The foot support according to claim 1, wherein the tensioning levers each have a notch on an outer side of a lower end of the lower lever arm and each further comprise an annular spring inserted into the notch, respectively, for securing the tensioning in the rest position.

7. The foot support according to claim 3, wherein the central area of the actuating element in the central area is comprised of a bracket that is closed on all sides and surrounds the ring, wherein the bracket is matched to an outer circumference of the ring such that the actuating element is pivotable relative to the ring.

8. The foot support according to claim 1, further comprising a stationary cylindrical body surrounding the receptacle, wherein the ring is guided along the stationary cylindrical body.

9. The foot support according to claim 3, wherein the foot lever extending out of the base member comprises a ratchet arrangement enabling a locking action of the twin-arm pivot lever in different pivot positions.

10. The foot support according to claim 9, wherein the ratchet arrangement comprises an L-shaped ratchet lever connected inside the base member to the foot lever and further comprises a toothed rack connected to the base member or the receptacle interacting with the ratchet lever.

11. The foot support according to claim 10, wherein the ratchet lever has a ratchet pawl, engaging teeth of the toothed rack, and a release lever extending out of the base member, wherein between the release lever and the foot lever a pressure spring is arranged for forcing the ratchet pawl into engagement with the teeth of the toothed rack.

12. The foot support according to claim 11, further comprising a tension spring arranged between the toothed rack and the actuating element such that the toothed rack with the teeth pointing inwardly is loaded toward the ratchet pawl and the actuating element is loaded upwardly.

* * * * *